US005213273A

United States Patent [19]

Linnerz

[11] Patent Number: 5,213,273

[45] Date of Patent: May 25, 1993

[54] HAMMER MILL

[75] Inventor: Wilhelm Linnerz, Kaarst, Fed. Rep. of Germany

[73] Assignee: Lindemann Maschinenfabrik GmbH, Dusseldorf, Fed. Rep. of Germany

[21] Appl. No.: 879,714

[22] Filed: May 6, 1992

Related U.S. Application Data

[63] Continuation of Ser. No. 693,719, Apr. 30, 1991, abandoned.

[30] Foreign Application Priority Data

May 21, 1990 [DE] Fed. Rep. of Germany ..... 4016295

[51] Int. Cl.[5] ..... B02C 13/09

[52] U.S. Cl. ..... 241/73; 241/285.3

[58] Field of Search ..... 241/73, 32, 186.2, 186 R, 241/285 B

[56] References Cited

U.S. PATENT DOCUMENTS

| | | | |
|---|---|---|---|
| 3,480,214 | 11/1969 | Wageneder | 241/73 |
| 3,952,957 | 4/1976 | Maillet | 241/73 |
| 4,009,836 | 3/1977 | Strom et al. | 241/73 |
| 4,146,184 | 3/1979 | Whitney | 241/73 |
| 4,385,732 | 5/1983 | Williams | 241/167 |
| 4,813,620 | 3/1989 | Engelmohr et al. | 241/82 |
| 4,917,310 | 4/1990 | Carrera | 241/32 |
| 4,982,904 | 1/1991 | Greiner | 241/73 |
| 5,044,567 | 9/1991 | Hte et al. | 241/73 |

FOREIGN PATENT DOCUMENTS

| | | | |
|---|---|---|---|
| 0080621 | 6/1983 | European Pat. Off. . | |
| 0254173 | 1/1988 | European Pat. Off. . | |
| 1134875 | 8/1962 | Fed. Rep. of Germany | 241/32 |
| 1262108 | 2/1968 | Fed. Rep. of Germany . | |
| 2713177 | 10/1978 | Fed. Rep. of Germany . | |
| 20595 | 1/1961 | German Democratic Rep. . | |
| 276433 | 2/1990 | German Democratic Rep. . | |
| 8902784 | 4/1989 | PCT Int'l Appl. . | |

*Primary Examiner*—Mark Rosenbaum
*Assistant Examiner*—John M. Husar
*Attorney, Agent, or Firm*—Anderson Kill Olick & Oshinsky

[57] ABSTRACT

In a hammer mill (1) for shredding scrap metal, comprising a hammer rotor (5) carrying swing-mounted hammers (12) and arranged to rotate in a housing (2) having an inlet opening (14) for material located on the upwardly-rotating side of the rotor, a screening grid (33) and an impact chute (26) open to the hammer rotor, the risk of breakdown of the hammer mill is reduced without impairing its shredding performance by forming the wall of the impact chute (26) on the side opposite to the inlet opening (14), together with a screening grid (33) extending to the bottom (32) of the housing, as a resiliently yielding outlet wall (28) that can automatically swing outwards.

8 Claims, 2 Drawing Sheets

HAMMER MILL

This is a continuation application of Ser. No. 07/693,719, filed Apr. 30, 1991 now abandoned.

TECHNICAL FIELD OF THE INVENTION

The invention relates to a hammer mill for shredding scrap metal, comprising a housing in which a hammer rotor with swinging hammers rotates, having an inlet opening for material located on the upwardly rotating side of the rotor, a screening grid and an impact chute open to the hammer rotor.

BACKGROUND OF THE INVENTION AND PRIOR ART

A hammer mill of this type is known from German patent 2713177. The shredding of the scrap charged, which is often bulky scrap such as automobile bodies or medium heavy mixed scrap, is effected both by the cooperation of the rotor hammers with anvils spaced from the striking circle of the hammers and by the impact of the material with the inside walls of the impact chute, against which it is flung. The rotor hammers, of which there may be any desired number in any desired distribution, may be mounted on freely rotatable axle rods arranged parallel to the rotor shaft and spaced apart around the periphery of the rotor. In this hammer mill the upper edge of the inlet opening forms part of a replaceable anvil with a gap between it and the striking circle of the hammers; a further anvil may be located on the lower edge of the side wall of the impact chute adjacent to the material outlet, and hence—viewed in the direction of rotation of the rotor—above the screening grid of the material outlet opposite the material inlet.

In operation, the hammers, with the anvil serving as counterpart tool, cut or tear pieces of material from the scrap metal supplied and fling these pieces against the walls of the impact chute, the bottom opening of which extends over the hammer rotor from the inlet to the outlet. This leads to deformation of, for example, impacting pieces of sheet metal and their separation from adherent impurities, and at the same time to compaction of the material, while more massive pieces of metal are deformed to a lesser extent but are likewise freed from adherent impurities before they again come within reach of the hammers before the outlet. Further shredding of the material can take place on an optional anvil of the outlet, whereafter the shredded material is ejected through the screening grid. Pieces larger than the width of the grid openings are dragged past the screening grid of the outlet and again subjected to the action of the shredding and counterpart tools.

To remove massive pieces of material that cannot be shredded to the size of the grid openings or smaller, and which advertise their presence in the hammer mill by loud noises, the operators must swing an ejection door in the impact chute inwards in the housing to a position in which it crosses the trajectory of the pieces, whereupon the door guides the pieces striking it to the exterior. Nevertheless it is not impossible for the massive problem material to become jammed in the space between the striking circle of the hammers and the screening grid of the outlet and/or the closed base of the housing. Less problems arise with smaller pieces, as the mass of the hammer can easily prevail on its own, i.e. the hammer can shred the piece that is jammed in the grid and/or compact it and pass it. When processing large, massive pieces of scrap, on the other hand, problems can arise which lead to quite serious breakdowns in operation.

When processing heavy material the rotor is usually driven relatively slowly. Particularly when the rotor is rotating only slowly a large piece that becomes jammed in the housing of the hammer mill in the region of the striking circle of the hammers may not be shredded and may not even be passed through because at the point of impact the rotor hammer may be in such a poor kinematic position that no deflecting rotary movement about its axle rod is possible. It also often happens that at least one of the hammers is stopped, at least for a short time, by the large and often heavy piece that is obstructing the striking circle. In these circumstances the forces of reaction that arise when the hammer is stopped by the large piece may, because of an unfavourable lever relationship, lead to fracture of the bearing axle or stub axles carrying the rotor hammers or of the rotor hammer itself, or even to bursting of the housing of the hammer mill.

OBJECT OF THE INVENTION

It is an object of the invention to improve a hammer mill of the kind described so as to reduce the risk of breakdowns without impairing the shredding performance.

SUMMARY OF THE INVENTION

To this end, according to the invention, the wall of the impact chute on the opposite side to the inlet opening is formed, together with a screening grid that extends to the bottom of the housing, as a resiliently yielding outlet wall that is pivoted to swing automatically outwards Furthermore the bottom of the housing may be formed as a resiliently yielding swing grid pivoted to swing automatically outwards. The invention makes it possible, depending on the nature of the scrap metal to be shredded, either to position the outlet wall as close as possible to the rotor or to the impact circle of its hammers or to provide a gap of any desired width between the rotor and the outlet wall. When the outlet wall is positioned close to the rotor the scrap metal charged is subjected to intensive impact treatment in the impact chute to clean and compact the material. Material that has been brought to the size of the openings in the screening grid can escape outwards, while material that has not yet been sufficiently shredded and compacted is again subjected to the shredding process and makes at least one further shredding circuit. In contrast to this, when processing medium heavy mixed scrap, of which only the lighter constituents can be shredded and/or compacted, the outlet wall is positioned at a correspondingly large distance from the rotor. The whole of the material to be shredded, including the large, heavy pieces it contains, passes safely out through the gap between the swung-out outlet wall and the rotor, so that no more large pieces can reach the bottom region of the hammer mill. Stopping of the rotor hammers by a large, heavy piece, and resulting damage to the axle rods or the rotor itself, are thus prevented.

In each case, both when the outlet wall and/or swing grid is or are swung out and when they are positioned as close as possible to the rotor, the multipart outlet wall and the resilient yielding of its separate parts enable the outlet wall and/or the swing grid, when the kinetic energy of the impacting material striking it is high enough or when radial forces are transmitted by a large piece between the hammer rotor and the outlet wall of the swing grid, to yield resiliently to some extent so as to open up a larger gap through which a large piece can be removed. The outlet wall with the screening grid and the swing grid in the bottom region can thus swing out in succession in the direction of rotation of the rotor in the manner of wings and yield to large pieces.

Forming the bottom of the housing as a pivotably mounted and preferably two-part swing grid comprising a closed (imperforate) bottom shell and a pivotable swing grid bridging the distance between this shell and the screening grid of the outlet wall also allows a gap to be formed in the bottom part of the housing that is large enough for large pieces that may get that far to fall out. Lastly it is also possible to preset the swung-out position of the swing grid, in which it is spaced from the rotor, when processing a material which experience has shown will already have been sufficiently shredded and/or compacted when it reaches this region of the rotor, for a further shredding circuit to be unnecessary.

When, as is preferred, the outlet wall and the swing grid are mounted on pivot axles that pass outwardly through the housing and at least one end of each pivot axle is provided, outside the housing, with a lever arm that engages with a hydraulic piston/cylinder unit, a pressure relief valve can be provided in the pressure line of the hydraulic cylinder to give resiliently yielding, automatically out-swinging mounting of the outlet wall and/or swing grid.

The end of the swing grid facing the screening grid of the outlet wall, which like the swing grid is arcuate, may have an anvil. If, when the outlet wall is swung out, a large, heavy piece has not been carried through the gap opening, it will either be further shredded on impact with the anvil before it reaches the region of the swing grid at the bottom which, together with the outlet wall, forms the outlet, or the large piece will exert such a large radial force on the anvil that the swing grid will swing resiliently outwards.

Thus as soon as large forces, exceeding the pressure to which the hydraulic cylinder has been adjusted, are set up on the outlet wall and/or the swing grid a corresponding amount of hydraulic fluid will be expelled through the pressure relief valve in the pressure line that is connected ahead of the piston face being loaded and via a line into a tank, resulting in a resilient deflection, since the piston returns to its position in the cylinder. In closed circuit operation, e.g. predominantly in the processing of sheet metal scrap, for example automobile bodies and household appliances, the bottom of the housing and the outlet wall are adjusted so that the swing grid, which is fitted under the impact chute at about the height of the striking circle of the rotor hammers and extends at least to the horizontal plane containing the rotor axle, is as close as possible to the rotor. Despite this, no large pieces can become wedged between the rotor and the bottom of the housing and bring the rotor to a standstill or even tear it out of its bearings: if a large piece that has still not been sufficiently shredded despite its previous impact with the anvil of the swing grid should reach the region of the bottom of the housing, the swing grid will open automatically under the force produced by the large piece to give a gap corresponding to the size of the large piece. Consequently the large piece will be ejected at this part of the outlet without being able to block the hammers of the hammer rotor.

BRIEF DESCRIPTION OF THE DRAWINGS

The invention will now be described in more detail, by way of example, with reference to the embodiments shown in the drawings, in which.

DETAILED DESCRIPTION OF A PREFERRED EMBODIMENT OF THE INVENTION

Figure 2:
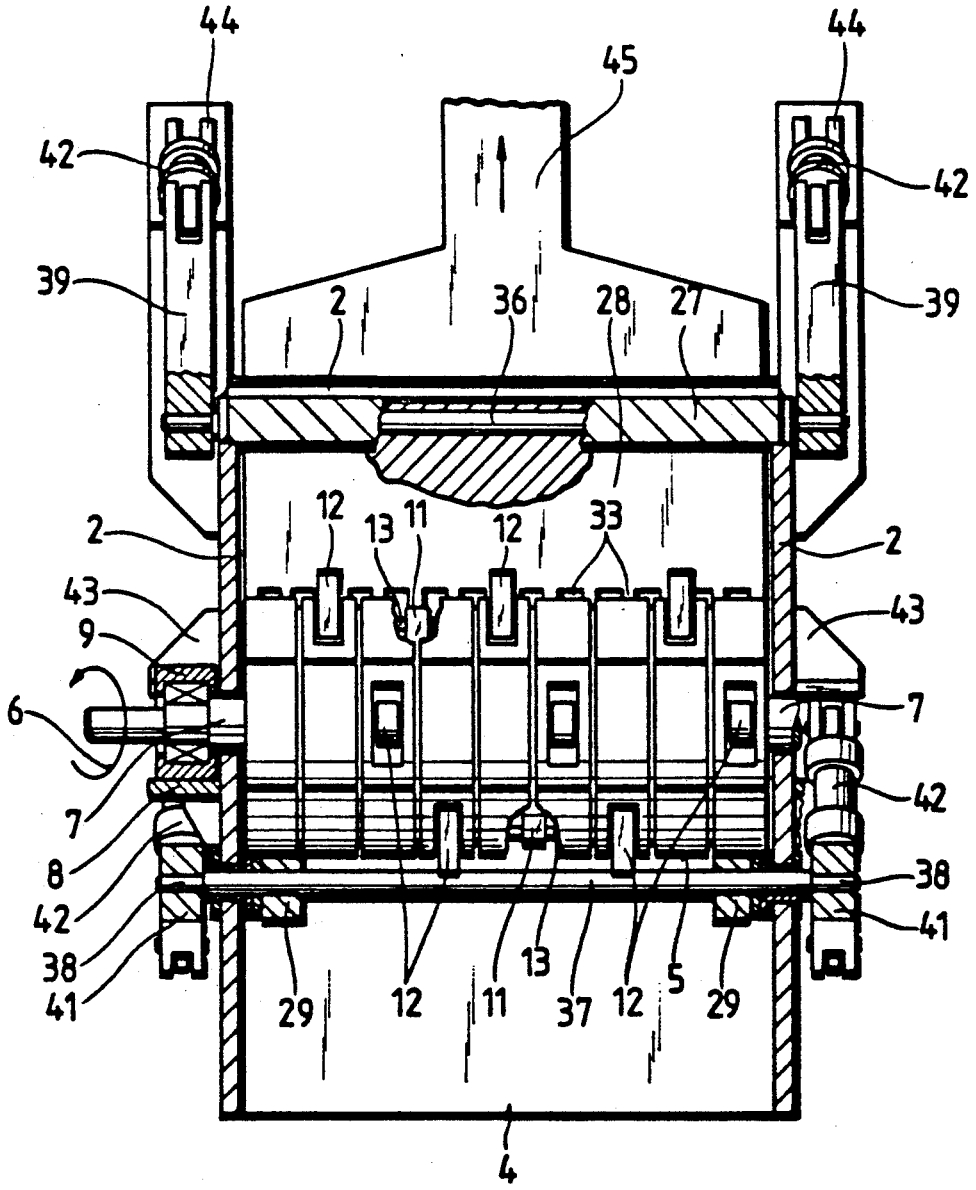
FIG. 2 is a section on the line II—II through the hammer mill of FIG. 1.

A hammer mill 1 has a housing 2 anchored by bearers 3 to a base structure 4. In the housing 2 a hammer rotor 5 rotates in the direction 6 with its shaft mounted in bearings 9 fixed on bearing blocks 8 (cf. FIG. 2). The hammer rotor 5 comprises a plurality of rotor discs 11 arranged side by side but spaced apart on a shaft 7 and having hammers 12 mounted to rotate on axles 13 that pass through the rotor discs 11 parallel to and spaced radially from the shaft 7. The shaft 7 is connected to a drive by a coupling (not shown).

An inlet 14 and an outlet 15 for material are provided in the housing 2. The inlet 14 is located on the upwardly rotating side of the hammer rotor 5. The upper edge of the inlet is part of a replaceable anvil 16 and extends close to the striking circle 17 of the hammers of the hammer rotor 5. An upper and a lower feed roll 19, 21 and a precompacting wall 22 are located in a supply passage 18 leading to the inlet 14. At least one pivoting hydraulic cylinder 23 engages with the precompacting wall 22 to swing it down into the supply passage from its inoperative position, shown in broken lines, to act as a stamp so as to precompact the charged material (scrap metal) and reduce its volume. The roll gap 24 between the feed rolls 19, 21 is selected according to the degree of precompaction used; for this purpose the upper roll 19 is mounted in a pivot lever 25 that allows the roll gap 24 to be adjusted.

In the region between the inlet 14 and the outlet 15 the part of the housing lying above the hammer rotor 5 is formed as an impact chute 26 open only at the bottom. At the top the impact chute 26 is covered, i.e. closed off from the outside, by a wall 27 extending tangentially to the direction of rotation 6 of the hammer rotors 5. The height h of the impact chute is from about D/2 to D, where D is the diameter of the hammer rotor. This diameter D is from 1.5 to 2.5 m. At smaller values of D the value of h corresponds more to the value D, while at larger values of D, h approaches more nearly to D/2; The outlet 15 is formed in several parts; it comprises the wall of the impact chute 26 at the opposite side to the inlet 14, formed as a swingable outlet wall 28 with a screening grid 33 and a swing grid 29 forming part of the bottom 32 of the housing. The housing bottom 32 also includes a bottom shell 31 extending in the direction of rotation 6 from adjacent the swing grid 29 to the inlet 14. The outlet wall 28 of the impact chute 26, together with its prolongation formed by the screening grid 33, extends to the bottom 32 of the housing. The screening grid 33 is positioned beneath the impact chute 26 and above the hammer rotor 5, at about the level of the hammer striking circle 17, and—like the swing grid 29 and the bottom shell 31 of the housing bottom 32—is arcuate. After an arc length corresponding to about a quarter-circle of the hammer rotor 5 the screening grid 33 ends immediately in front of an anvil 34 forming part of the swing grid 29. The anvil 34 lies with its upper edge facing the direction of rotation 6 of the hammer rotor 5 below the horizontal axis 35 passing through the rotor shaft 7.

Figure 1:
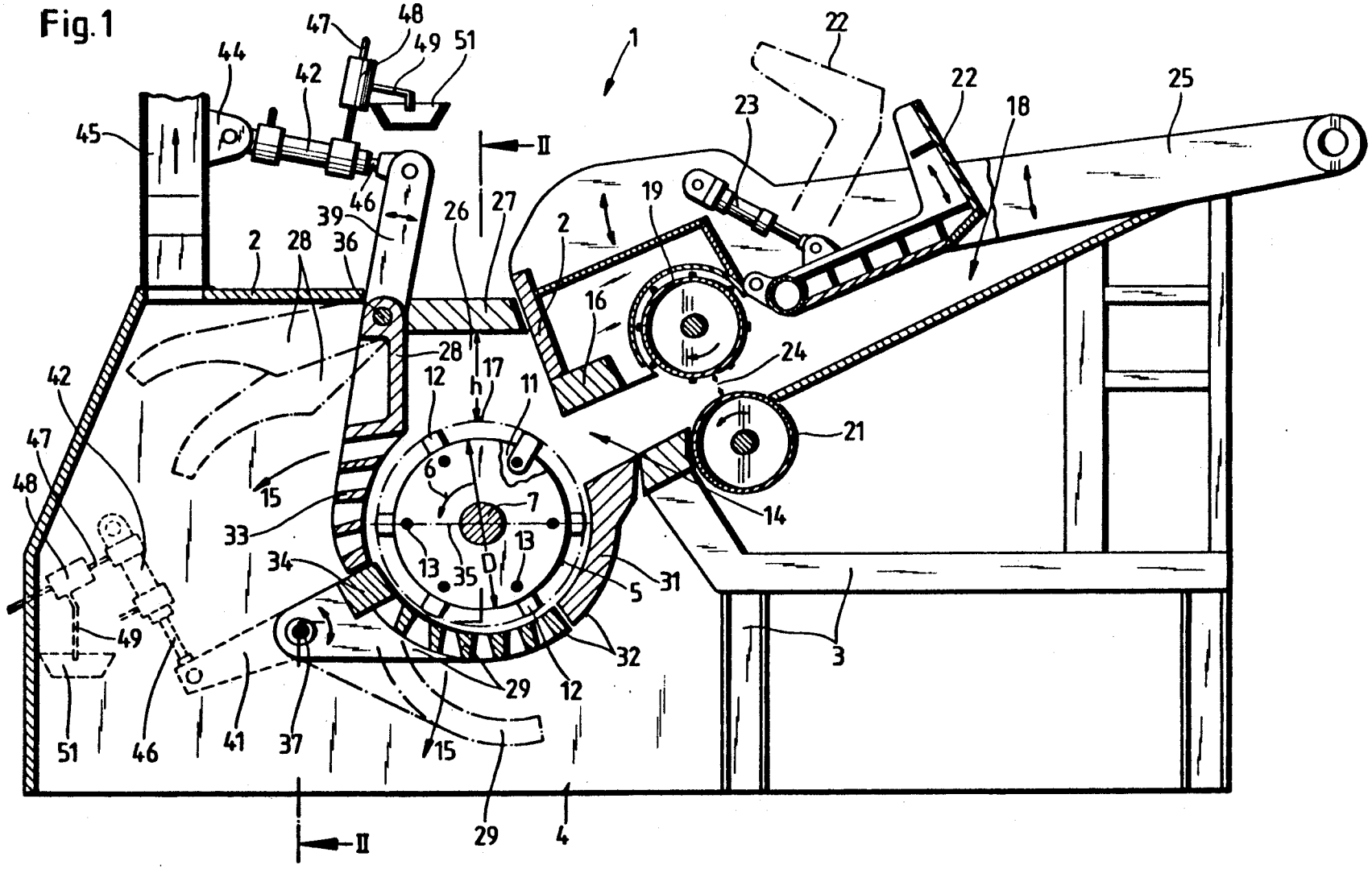
FIG. 1 is a longitudinal section through a hammer mill according to the invention.

Both the outlet wall 28 and the swing grid 29 are mounted on pivot axles 36, 37 passing outwardly through the housing 2. The pivot axles 36, 37 are provided on their two ends 38 lying outside the housing 2 with lever arms 39, 41, with each of which a respective hydraulic cylinder unit 42 engages (cf. FIG. 2). The hydraulic cylinders 42 are articulated at their rear ends in bearing blocks 43 forming part of the housing 2 (cf. FIG. 2) or bearing blocks 44 in the region of a dust-removal duct 45 in the housing 2 and with their piston rods 46 linked to the lever arms 39, 41 of the outlet wall 28 or of the swing grid 29. The outlet wall 28 with its screening grid 33 and the swing grid 29 can be moved from their operating position, shown in FIG. 1 by continuous lines and in which they are located as near as possible to the striking circle 17, to the opened, swung-out position spaced from the hammer rotor 5 shown in FIG. 1 by chain lines.

In each of the pressure lines 47 that open to the loaded piston faces (not shown) of the hydraulic cylinder unit 42 there is a pressure-relief valve 48 connected by a line 49 to a tank 51. The valves 48 make possible a resiliently yielding arrangement of the material outlet 15, i.e. of the outlet wall 28 and the swing grid 29, both when these parts of the outlet are in the closed operating position shown by full lines in FIG. 1 and when they are in the swung-out operating position indicated by chain lines.

The method of operation of the hammer mill 1 according to the invention that has just been described will now be explained for the case in which the outlet wall 28 and the swing grid 29 (shown as in FIG. 1 in full lines) are in the closed operating position. While the hammer rotor 5 is rotating in the direction 6 material for shredding, which in the closed operating position of the outlet wall 28 and the swing grid 29 is preferably automobile bodies and household appliances, is continuously delivered through the inlet 14 by means of the feed rolls 19, 21 via the supply passage 18 into the operating zone of the hammer rotor 5. With the anvil 16 arranged on the upper edge of the inlet as counterpart tool the hammers 12 cut or tear pieces from the material supplied and fling them tangentially into the impact chute 26, mainly on to the upper wall 27 located above the impact chute. The rebounding pieces of scrap are thereby deformed in the sense of balling together. Pieces of material that are of small enough dimensions and are flung at a high enough velocity exactly into the grid openings of the screening grid 33 of the outlet wall 28 pass at once through the outlet wall 28 or the screening grid 33. Any large pieces that nevertheless do not strike the outlet wall energetically enough to cause the outlet wall 28 and the screening grid 33 to yield sufficiently will, as the screening grid 33 is to some extent swung out, strike the anvil 34 of the swing grid 29. For only when large enough forces are set up will hydraulic fluid be forced out of the hydraulic cylinders 42 into the tank 51 via the pressure relief valves 48 and the lines 48 so that the outlet wall 28, together with the screening grid 33 is resiliently deflected and large pieces ejected. On the anvil 34 a large piece that is not ejected through the outlet wall 28 or the screening grid 33 will be further shredded; if it has still not been reduced in size far enough for it to be able to emerge through the openings in the swing grid 29, the swing grid 29 is also automatically and resiliently deflected, through the action of the pressure relief valves 48 in the pressure lines of its cylinder 42, by an amount corresponding to the thickness of the large piece. The large piece is thrown out without blocking the hammers 12 and/or the hammer rotor 5.

The multipart material outlet 15 according to the invention not only allows the outlet wall 28 with the screening grid 33 and the swing grid 29 to be preset in desired opening positions, but also, in all operating positions, makes it possible for them to be resiliently and yieldably deflected in succession in the direction of rotation 6 of the rotor 5. Thus on the one hand, corresponding to the material being fed, the outlet openings can be set in advance so that heavy and large constituents are removed from the shredding process at any desired positions. If however large pieces remain in the shredding process and are carried round by the hammer rotor 5 in the direction of rotation 6, the outlet wall 28 with the screening grid (33) and/or the swing grid 29 can be deflected away from the hammer rotor 5. Wedging of the large pieces between the hammer rotor 5 and the outlet 15, i.e. the outlet wall 28 or the swing grid 29, is thus prevented.

What is claimed is:

1. A hammer mill for shredding a scrap metal commodity, comprising:

a housing;

a shaft rotatably supported in said housing; and a hammer rotor supported on said shaft for joint rotation therewith;

said housing including:

an inlet located on an upwardly rotating side of said hammer rotor, a first anvil located at an upper edge of said inlet, an outlet, an impact chute located in a region between said inlet, and above said hammer rotor, said impact chute having an open bottom and including a pivotable wall located opposite said inlet and having a screening grid portion, said pivotable wall defining an outlet wall of said outlet, a bottom having a swing grid portion and a shell portion extending between said grid portion and said inlet, and a second anvil located on said swing grid portion, said outlet wall extending to said swing grid portion.

2. The hammer mill of claim 1, wherein said swing grid portion of said bottom is resiliently yieldable and is able to automatically pivot outward under action of scrap metal commodity pieces of a predetermined volume, and wherein said shell portion is stationary.

3. The hammer mill of claim 2, wherein said second anvil is located at an end of said swing grid portion of said bottom, remote form said shell portion, wherein said outlet wall extends to said anvil.

4. The hammer mill of claim 1, wherein said hammer rotor comprises a plurality of rotor disks arranged on said shaft, a plurality of axles passing through said rotor discs, and a plurality of hammers mounted rotatably on said axles.

5. The hammer mill of claim 1, further comprising a passageway located adjacent to said inlet for passing the scrap metal commodity from outside of said hammer mill to said inlet, and compacting means arranged in said passageway for reducing volume of the scrap metal commodity.

6. The hammer mill of claim 1, wherein said outlet wall and said grid portion are mounted on pivot axles which pass outward through said housing, and wherein at least one end of each of said pivot axles is provided, outside of said housing, with a lever arm which engages with a hydraulic piston/cylinder unit.

7. The hammer mill of claim 6, wherein a pressure relief valve is provided in a pressure line of said hydraulic piston/cylinder unit.

8. The hammer mill of claim 1, wherein said screening grid portion and said swing grid portion of said bottom are arcuate.

* * * * *